US006966161B2

(12) United States Patent
Pálsson et al.

(10) Patent No.: US 6,966,161 B2
(45) **Date of Patent: *Nov. 22, 2005**

(54) VERTICALLY JOINED FLOOR ELEMENTS COMPRISING A COMBINATION OF DIFFERENT FLOOR ELEMENTS

(75) Inventors: Jörgen Pálsson, Landskrona (SE); Ingvar Sylegård, Hässleholm (SE)

(73) Assignee: Pergo (Europe) AB, Treeleborg (SE)

( * ) Notice: Subject to any disclaimer, the term of this patent is extended or adjusted under 35 U.S.C. 154(b) by 343 days.

This patent is subject to a terminal disclaimer.

(21) Appl. No.: 10/360,623

(22) Filed: Feb. 10, 2003

(65) Prior Publication Data

US 2003/0145549 A1 Aug. 7, 2003

Related U.S. Application Data

(63) Continuation of application No. 09/672,077, filed on Sep. 29, 2000, now Pat. No. 6,536,178.

(30) Foreign Application Priority Data

Mar. 10, 2000 (SE) ..... 0000785

(51) Int. Cl.[7] ..... E04F 15/02; E04B 2/08

(52) U.S. Cl. ..... 52/589.1; 52/592.3; 52/588.1; 52/392; 404/41

(58) Field of Search ..... 52/586.1, 582.1, 52/589.1, 590.2, 592.3, 591.1, 390–392, 52/461–463, 588.1, 578, 471; 404/34–35, 404/41; 403/364, 381

(56) References Cited

U.S. PATENT DOCUMENTS 714,987 A * 12/1902 Wolfe ..... 52/578
2,004,193 A * 6/1935 Cherry ..... 52/506.1
2,740,167 A * 4/1956 Rowley ..... 52/591.1
3,444,660 A * 5/1969 Feichter et al. ..... 52/389
3,479,784 A * 11/1969 Massagli ..... 52/588.1
3,553,919 A * 1/1971 Omholt ..... 52/506.1
3,720,027 A * 3/1973 Christensen ..... 52/309.8
3,731,445 A * 5/1973 Hoffmann et al. ..... 52/391
3,798,111 A * 3/1974 Lane et al. ..... 428/219
3,807,113 A * 4/1974 Turner ..... 52/314
3,859,000 A * 1/1975 Webster ..... 404/41
3,921,312 A * 11/1975 Fuller ..... 434/96
4,426,820 A * 1/1984 Terbrack et al. ..... 52/590.1
4,449,346 A * 5/1984 Tremblay ..... 52/509
5,117,603 A * 6/1992 Weintraub ..... 52/390

(Continued)

*Primary Examiner*—Winnie Yip
(74) *Attorney, Agent, or Firm*—Stevens, Davis, Miller & Mosher, L.L.P.

(57) ABSTRACT

Vertically joined flooring material comprising floor elements (1) with a mainly triangular, square, rectangular, rhomboidal or polygonal shape, as seen from above. The floor elements (1) are provided with edges (2) which are provided with joining members (20), a lower side (5) and a decorative top surface (3). The flooring material comprises a combination of at least two types of floor elements (1), which types comprises female floor elements (1') and male floor elements (1"). The female floor element (1') is provided with a female joining member (21) on at least half of the number of its edges (2) and a male joining member (22) on less than half of the number of its edges (2). The male floor element (1") is provided with a male joining member (22) on at least two thirds of the number of its edges (2) and a female joining member (21) on less than one third of the number of its edges (2.) An optional joining profile (50) possibly constitutes a junction between two adjacent male joining members (22) of two adjacent floor elements (1).

7 Claims, 12 Drawing Sheets

U.S. PATENT DOCUMENTS 5,148,850 A * 9/1992 Urbanick ..... 160/231.1
5,216,861 A * 6/1993 Meyerson ..... 52/733.4
5,295,341 A * 3/1994 Kajiwara ..... 52/586.2
5,325,649 A * 7/1994 Kajiwara ..... 52/586.1
5,344,700 A * 9/1994 McGath et al. ..... 428/304.4
5,348,778 A * 9/1994 Knipp et al. ..... 428/35.8
5,502,939 A * 4/1996 Zadok et al. ..... 52/309.9
5,527,128 A * 6/1996 Rope et al. ..... 404/35
5,630,304 A * 5/1997 Austin ..... 52/384
5,706,621 A * 1/1998 Pervan ..... 52/403.1
5,791,114 A * 8/1998 Mandel ..... 52/591.3
5,797,237 A * 8/1998 Finkell, Jr. ..... 52/589.1
5,860,267 A * 1/1999 Pervan ..... 52/748.1
5,907,934 A * 6/1999 Austin ..... 52/177
5,971,655 A * 10/1999 Shirakawa ..... 404/40
6,006,486 A * 12/1999 Moriau et al. ..... 52/589.1
6,023,907 A * 2/2000 Pervan ..... 52/748.1
6,094,882 A * 8/2000 Pervan ..... 52/745.19
6,101,778 A * 8/2000 M.ang.rtensson ..... 52/582.1
6,182,410 B1 * 2/2001 Pervan ..... 52/403.1
6,205,639 B1 * 3/2001 Pervan ..... 29/509
6,209,278 B1 * 4/2001 Tychsen ..... 52/592.4
6,216,409 B1 * 4/2001 Roy et al. ..... 52/589.1
6,314,701 B1 * 11/2001 Meyerson ..... 52/588.1
6,324,803 B1 * 12/2001 Pervan ..... 52/403.1
6,397,547 B1 * 6/2002 M.ang.rtensson ..... 52/582.1
6,418,683 B1 * 7/2002 Martensson et al. ..... 52/282.1
6,421,970 B1 * 7/2002 Martensson et al. ..... 52/282.1
6,647,690 B1 * 11/2003 Martensson ..... 52/601
6,763,643 B1 * 7/2004 M.ang.rtensson ..... 52/586.1

* cited by examiner

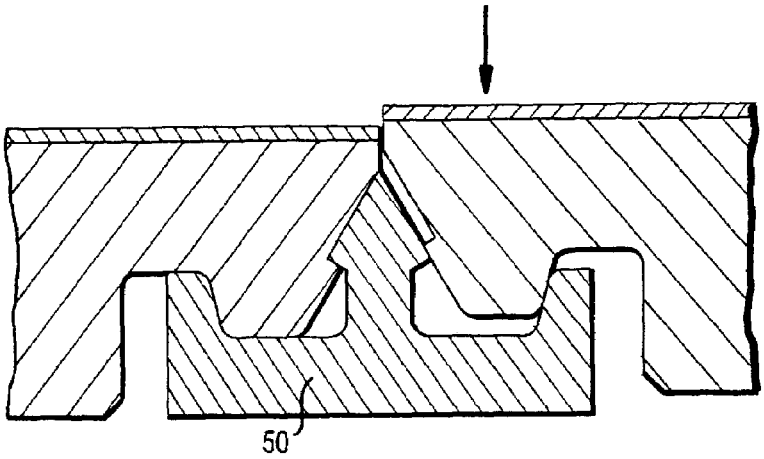
FIG. 5
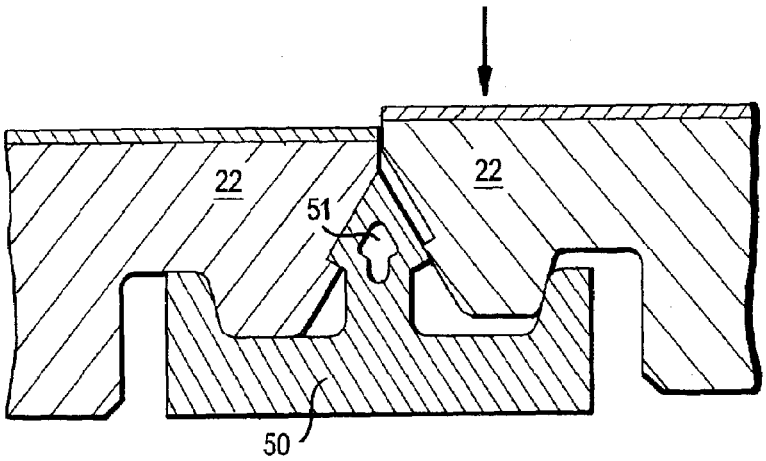
FIG. 6
FIG. 7a
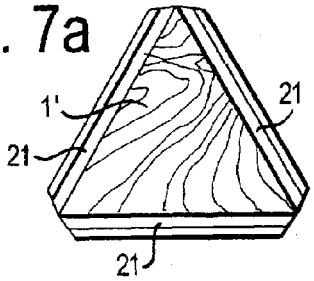
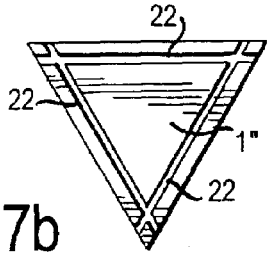
FIG. 7b
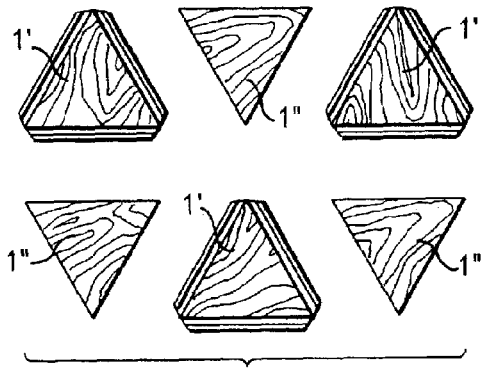
FIG. 7c FIG. 8a
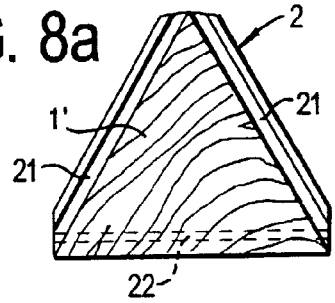
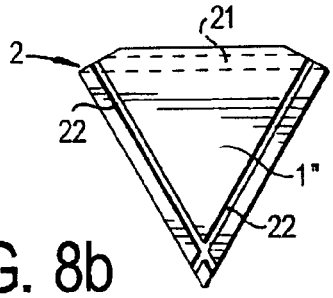
FIG. 8b
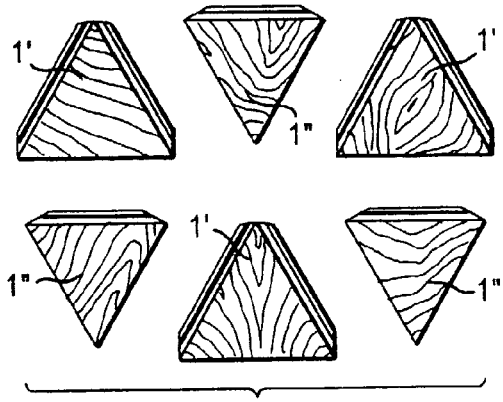
FIG. 8c
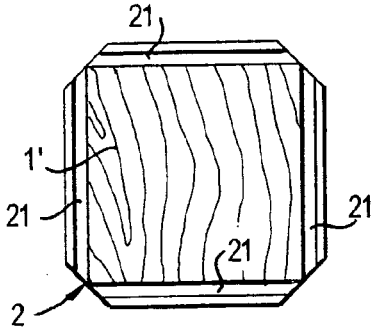
FIG. 9a
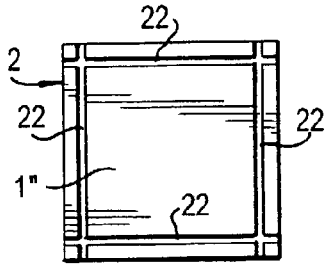
FIG. 9b
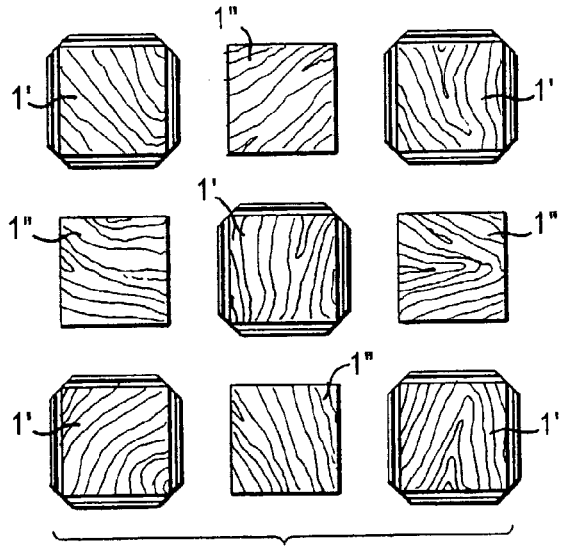
FIG. 9c

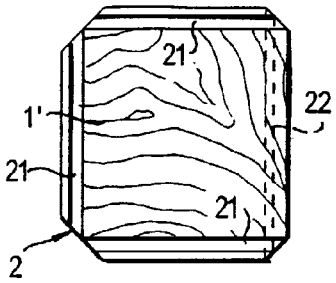
FIG. 10a
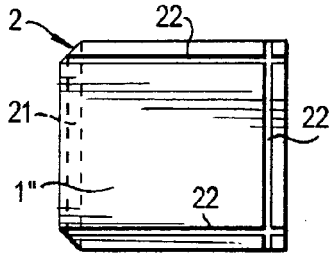
FIG. 10b
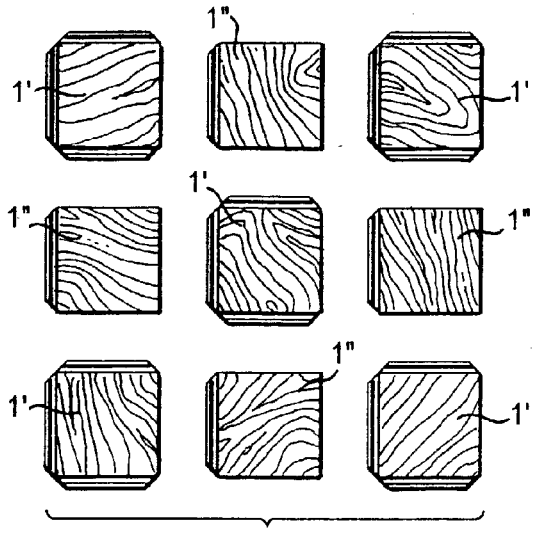
FIG. 10c
FIG. 16a
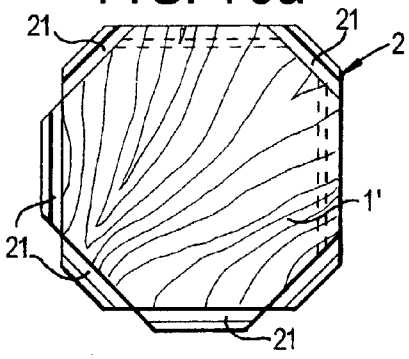
FIG. 16b
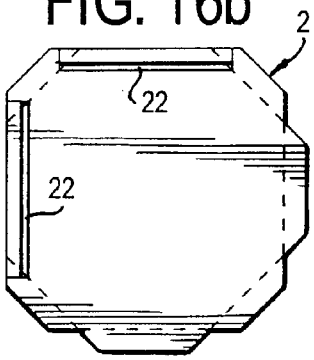
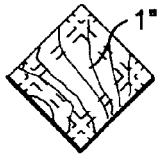
FIG. 16c
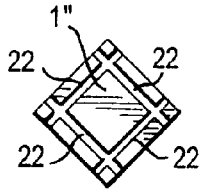
FIG. 16d
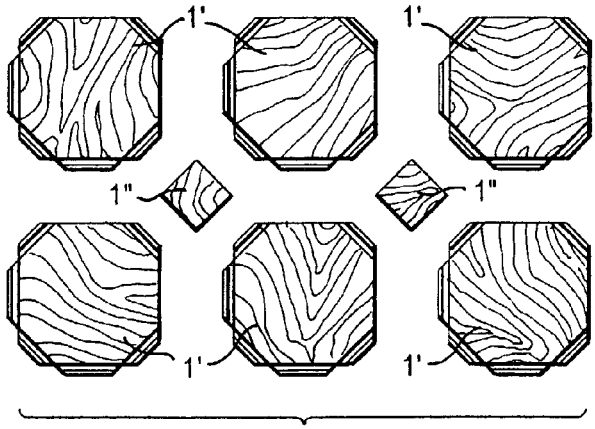
FIG. 16e

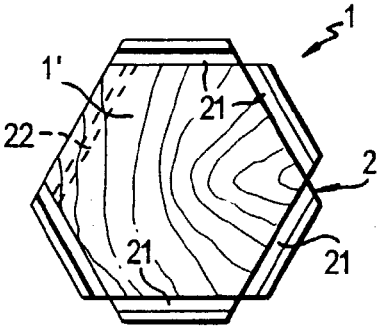
FIG. 14a
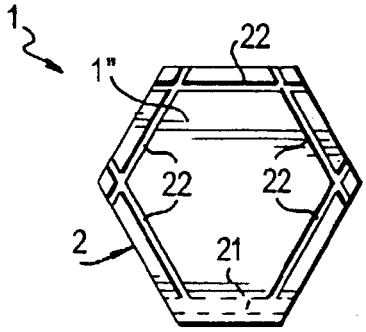
FIG. 14b
FIG. 14c
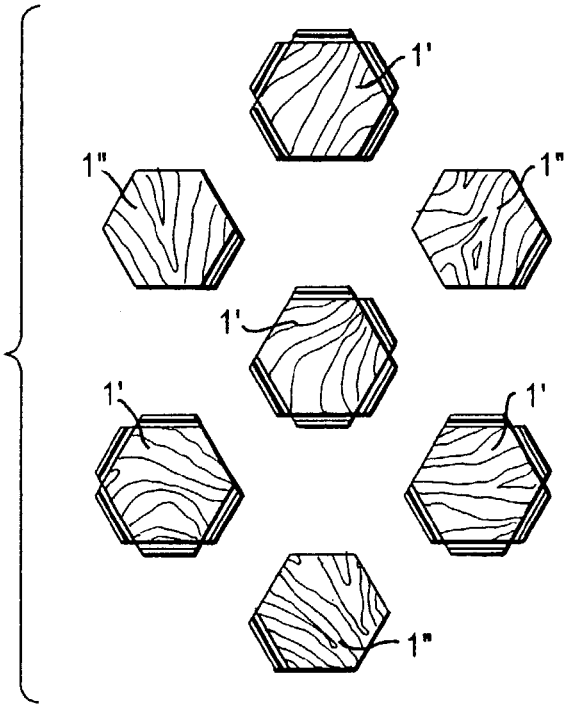
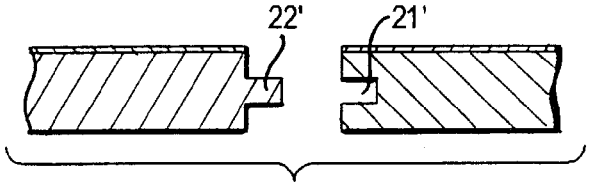
FIG. 18

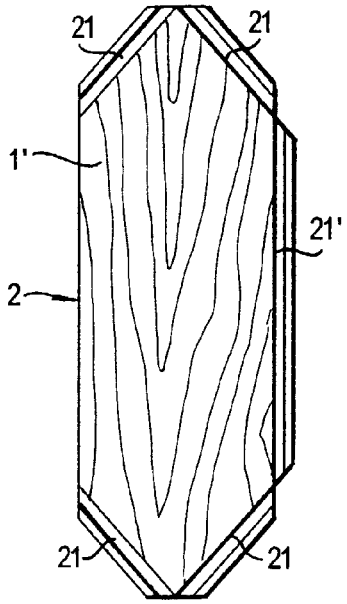
FIG. 15a
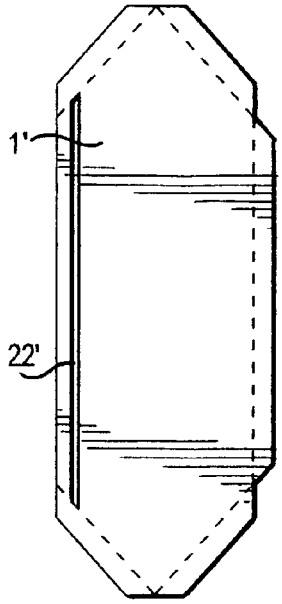
FIG. 15b
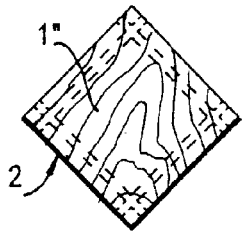
FIG. 15c
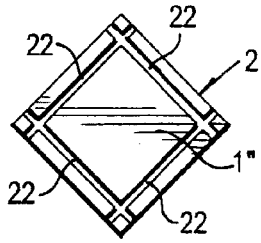
FIG. 15d
FIG. 15e
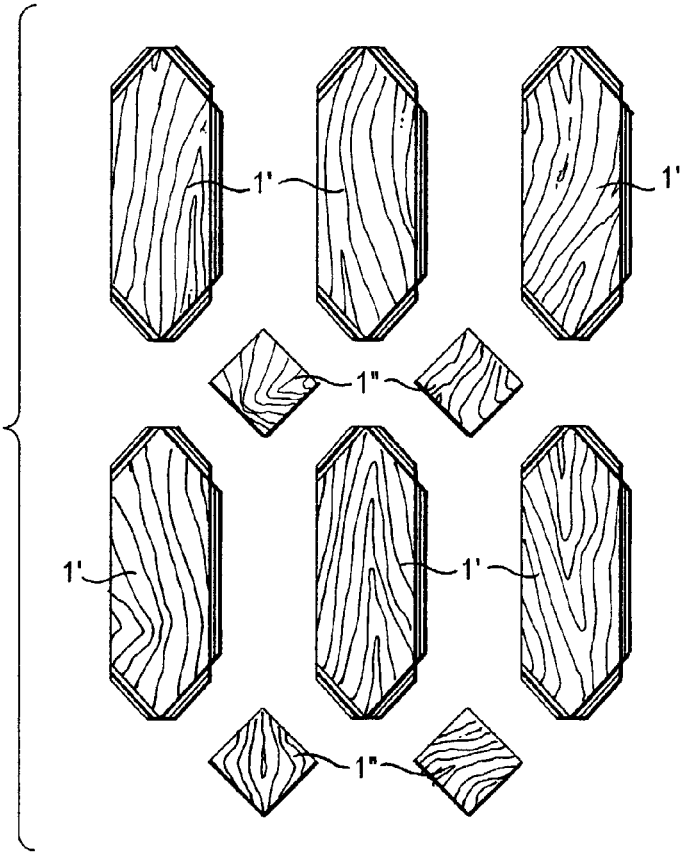

VERTICALLY JOINED FLOOR ELEMENTS COMPRISING A COMBINATION OF DIFFERENT FLOOR ELEMENTS

This application is a Continuation of U.S. application Ser. No. 09/672,077, filed Sep. 29, 2000, now U.S. Pat. No. 6,536,178, claiming priority from Swedish Application No. 000785-6, filed Mar. 10, 2000, the disclosures of which are hereby incorporated by reference in their entirety.

The present invention relates to a flooring material comprising a combination of floor elements which are joined.

Prefabricated floor boards which are provided with tongue and groove at the edges are well known today. As these are rather easy to install, this can be achieved by the average handy man. Such floors can be made of solid wood, particle board or fibre board. These floor boards are most often provided with a top surface, such as lacquer or some kind of laminate. The board are most often joined by being glued together via their tongue and groove. The most common types of floor boards are, however, burdened with the disadvantage to form gaps of varying width between the floor boards if the installer is not thorough enough. Dirt will accumulate in such gaps. Moisture will furthermore enter the joints which will cause the core to expand in cases where it is made of solid wood, fibre board or particle board which usually is the case. This expansion will cause the top surface to rise, closest to the joint, which radically decreases the useful life of the floor due to increased wear on the protruding edges of the floor board. In order to avoid this type of gaps it is known to use different type of tensioning devices used for forcing the floor boards together during installation. This operation is, however, rather awkward and it is desirable to achieve a floor board with a joint which is self-orienting and thereby automatically will find its correct position. It would also be possible to use such a joint without having to use glue.

One such floor is known through WO 93/13280 wherein a form of clips is intended to keep floor boards together. The floor boards are, besides being provided with traditional tongue and groove, also provided with a single longitudinal groove on the side facing downwards. The floor boards are resting on the clips why a great number of such clips will have to be used to avoid resilient movements in the floor. Such movements will cause noise. The distance between the floor boards and the surface below will also cause acoustic resonance which will give the floor a "noisy" character. This is not desirable. The disadvantage with a groove and tongue solution is foremost that the tongue will have to be milled from the board which will cause a loss of the expensive top surface. It will furthermore be possible to assemble the floor boards, oriented in one direction only. The tongue is also a delicate part which is easily damaged during transport and handling which makes assembly difficult or causes impaired fitting.

Another such floor is known through Swedish patent application No. 8202375-5 in which floor boards are provided with grooves at the opposite edges. A separate profile, in which a tongue is included, is used for guiding the boards horizontally. The lower part of the profile is also provided with girders protruding upwards. These girders are intended to interact with grooves on the lower side of the floor boards. A floor according to Se application No. 8202375-5 will however have to be assembled in a way that makes it necessary for the installer to stand on his knees since the floor will have to be turned into, or slided sideways, into the desired position.

It has, through the present invention been possible to solve the above mentioned problems, whereby a floor that can withstand handling, demands a minimum of milling of the decorative top surface and is easy to install has been achieved. Accordingly, the invention relates to a vertically joined flooring material comprising floor elements with a mainly triangular, square, rectangular, rhomboidal or polygonal shape, as seen from above. The floor elements are provided with edges which are provided with joining members. The floor elements are further provided with a lower side and a decorative top surface.

The invention is characterised in that the flooring material comprises a combination of at least two different types of floor elements, which types comprises female floor elements and male floor elements, whereby;

a) The female floor element is provided with a female joining member on at least half of the number of its edges and a male joining member on less than half of the number of its edges.

b) The male floor element is provided with a male joining member on at least two thirds of the number of its edges and a female joining member on less than one third of the number of its edges.

c) An optional joining profile possibly constitutes a junction between two adjacent male joining members of two adjacent floor elements.

The joining members are preferably designed as follows;

a) The female joining member comprises an upwards protruding lip, being parallel to the edge. The upwards protruding lip is provided with a guiding surface, the guiding surface facing the edge. The female joining member further comprises a locking groove, being parallel to the edge. The locking groove has a locking surface, facing downwards, which locking surface terminates in a locking edge. An angle $\alpha I$ between the guiding surface and a vertical plane is in the range 0–30° while an angle $\alpha II$ between the locking surface and a horizontal plane is in the range 0–30° as seen in a perpendicular cross-section.

b) The male joining member comprises a groove, being parallel to the edge, on the lower side. The groove is provided with a guiding face, the guiding face which is facing away from the edge. The male joining member further comprises a locking heel, being parallel to the edge. The locking heel has a locking face, facing upwards. An angle $\beta I$ between the guiding face and the vertical plane is in the range 0–30°, while an angle $\beta II$ between the locking face and a horizontal plane is in the range 0–30° as seen in a perpendicular cross-section.

The angles $\alpha I$ and $\beta I$ are preferably mainly the same and the angles $\alpha II$ and $\beta II$ are also preferably mainly the same.

It is, according to the invention, possible to utilise a joining profile, between two adjacent male joining members. This joining alternative has shown to be particularly advantageous in certain embodiments of the invention.

The joining profile comprises two upwards protruding rims, being parallel to each other and distanced from each other by a centre section. The two upwards protruding rims are provided with guiding areas, which guiding areas, are facing inwards. The joining profile is furthermore provided with two locking cheeks placed on an extension. The locking cheeks is provided with locking areas facing downwards, which locking areas terminates in a locking edge. An angle $\psi I$ between the guiding area and a vertical plane is in the range 0–30° while the angle $\psi II$ between the locking area and a horizontal plane is in the range 0–30° as seen in a perpendicular cross-section.

The angles αI, βI and ψI are preferably mainly the same and the angles αII, βII and ψII are preferably also mainly the same.

The part of the floor element located between each edge and its respective groove is preferably thinner than the maximum thickness of the floor board by means of a recess located on the lower side. The lower side of the floor element will hereby be flat when installed and will rest more securely on the supporting surface below. The lower side of the female joining member is preferably also provided with a recess on the lower side. Such a recess will make the assembly more smooth since the female joining member will be allowed to move downwards during the assembly without being obstructed by the surface below.

The distance between the upwards protruding rims of the joining profile is preferably somewhat smaller than the distance between the grooves of the male joining members placed on each side of and closest to the edge of two adjacent floor elements.

The joining profiles are suitably manufactured in long sections which may be cut into a desired length. The length of the joining profiles then suitably exceeds the length of a floor element before being cut. The joining profiles are preferably cut into predetermined lengths adapted to the actual use. These lengths are suitably somewhat shorter than the edge on which it is supposed to be fitted. In certain embodiments of the invention the edges, where such joining profiles are to be fitted, are short side edges of rectangular floor elements, also known as floor boards. A typical dimension of such floor boards is 1200 mm by 200 mm in which a suitable length of a joining profile used on such a short side edge would be 100–150 mm.

The floor elements according to the invention does not require an glue or any other additional parts or additives that keeps the floor elements together, since the floor elements snap-joins. It is however possible to partially coat the joining profiles and/or the floor elements are partially coated with glue or adhesive tape. The joining members and, when used, joining profile will then act as guiding device, ensuring that the joint becomes very tight.

According to an embodiment of the invention the female floor element is mainly triangular, as seen from above, and is provided with female joining members on all three edges, while the male floor element is mainly triangular, as seen from above, and is provided with male joining members on all three edges.

According to another embodiment of the invention the female floor element is mainly triangular, as seen from above, and is provided with female joining members on two edges and a male joining member on the remaining edge, while the male floor element is mainly triangular, as seen from above, and is provided with male joining members on two edges and a female joining member on the remaining edge.

According to yet another embodiment of the invention the female floor element is mainly square, as seen from above, and is provided with female joining members on all four edges while the male floor element is mainly square, as seen from above, and is provided with male joining members on all four edges.

According to yet another embodiment of the invention the female floor element is mainly square, as seen from above, and is provided with female joining members on three edges and a male joining member on the remaining edge, while the male floor element is mainly square, as seen from above, and is provided with male joining members on three edges and a female joining member on the remaining edge.

According to yet another embodiment of the invention the female floor element is mainly rectangular, as seen from above, and is provided with female joining members on two long side edges and one short side edge and a male joining member on the remaining short side edge, while the male floor element is mainly rectangular, as seen from above, and is provided with male joining members on two long side edges and one short side edge and a female joining member on the remaining short side edge.

According to yet another embodiment of the invention the female floor element is mainly rectangular, as seen from above, and is provided with female joining members on two long side edges and one short side edge and a male joining member on the remaining short side edge, while the male floor element is mainly rectangular, as seen from above, and is provided with male joining members on two long side edges and one short side edge and a female joining member on the remaining short side edge.

According to yet another embodiment of the invention the female floor element is mainly rectangular, as seen from above, and is provided with female joining members on two long side edges and male joining members on the short side edges, while the male floor element is mainly rectangular, as seen from above, and is provided with male joining members on all four edges and that the adjacent short side edges are joined by means of a joining profile.

It is possible to join female floor element and the male floor element with differing width to length ratio. A common length to width ratio is 6/1. It is possible to use other dimensions by choice as long as each row has the same width or multiples thereof.

According to yet another embodiment of the invention the female floor element is mainly hexagonal, as seen from above, and is provided with female joining members on five edges and a male joining member on the remaining edge, while the male floor element is mainly hexagonal, as seen from above, and is provided with male joining members on five edges and a female joining member on the remaining edge.

According to yet another embodiment of the invention the female floor element is mainly hexagonal with two of the parallel edges extended, as seen from above, and is provided with female joining members on five edges and a male joining member on one of the extended edges, while the male floor element is mainly square with male joining members on all four edges.

According to yet another embodiment of the invention the female floor element is mainly octagonal, as seen from above, and is provided with female joining members on six edges and male joining members on the two remaining edges, while the male floor element is mainly square with male joining members on all four edges.

According to a special embodiment of the invention the female and/or male floor element is provided with a female horizontal joining member on at least one edge and at least one male horizontal joining member on an opposite edge. These horizontal joining members may be of the traditional tongue and groove type as they are intended to be used for assemble a first type of floor elements horizontally. The second type of floor elements may then be installed vertically in the spaces formed between the already installed first type floor elements. The second type floor elements will then lock the adjacent floor elements together.

According to one alternative of the special embodiment of the invention the female floor element is mainly hexagonal with two of the parallel edges extended, as seen from above. It is provided with female joining members on the four shorter edges, a female horizontal joining member on one of the extended edges and, a male horizontal joining member on the remaining extended edge, while the male floor element is mainly square with male joining members on all four edges.

According to another alternative of the special embodiment of the invention the female floor element is mainly octagonal, as seen from above. It is provided with female joining members on four perpendicularly arranged edges, female horizontal joining members on two edges and male horizontal joining members on the two remaining edges, while the male floor element is mainly square with male joining members on all four edges.

The joining profiles are suitably manufactured in long sections which suitably are manufactured through extrusion which is a well known and rational manufacturing method.

Joining profiles according to the present invention may be manufactured from a number of materials and through a number of different manufacturing methods. Among suitable methods can be mentioned injection moulding and extrusion. Suitable materials are thermoplastic materials such as poly olefins, polystyrene, polyvinyl chloride or acrylnitril-butadiene-styrene-copolymer. These can be filled with for example sawdust, cellulose or lime to foremost increase the dimension stability but also to increase the adhesion when being glued.

The joining profiles may be provided in different lengths or in rolls which may be cut into a desired length during or before the assembly. The length of the joining profiles suitably exceeds the length of a floor element before being cut. One advantage with such long joining profiles is that joining profiles may be installed in full-length over, for example, the width of the floor which will reduce the risk for gaps in the joints in cases where the lateral joints overlap. Such assembly where the joints between the floor elements overlap in both directions may of course be used even if the joining profile has the same length as, or is shorter than, the floor elements. The shorter side edges of the floor elements may be joined by using shorter lengths of the joining profile. Such joining profiles for the short side edge is suitably delivered in lengths of 50–90% of the length of the short side edge. The joining profiles are installed gradually, where necessary, as each new floor element is joined with the previously installed one. The flooring material according to the present invention is very suited for being installed without any use of adhesives such as glue. It is of course possible to use adhesives to make the assembly more permanent by apply or coat parts of the joining profiles or parts of the floor element with glue or double-faced adhesive tape. The glue or tape is then suitably applied on the surfaces of the joining profiles situated between the lips as well as on the edges of the floor elements. Since selected embodiments of the floor elements according to the present invention is provided with the same geometry along all of the edges it will become possible to turn these floor elements in the desired direction. It will therefore be possible to perform patterned design installations for the layman.

According to the present invention the joining profiles may be used together with joining members in opposite to the most common types of flooring materials using tongue and groove. This will be a great advantage since it gives great flexibility for the installer. It becomes, for example, possible for the installer to create so-called inlays, made up by a number of floor elements, together creating a decorative star-pattern and snap join this inlay with a more traditional floor board pattern.

A flooring material according to the present invention is suited for installations without use of glue. It is of course possible to use glue or double-faced adhesive tape in order to make the installation completely permanent. The glue or tape is then suitably applied in, or in connection to, possible cavities in the joint before the assembly.

The floor elements according to the present invention is assembled by being pressed downwards to snap-join with previously installed floor elements. Commonly known floor boards are assembled horizontally by being forced or knocked together. Some known floor boards are assembled by being turned or prized into position. These known floor boards are guided vertically and in a few cases also horizontally on a great number of variations on the toungue-and-grove theme. It is very difficult to apply sufficient horizontal force manually at floor level whereby different types of tensioning devices are essential when installing such floors. The installer will only have to apply some of his body weight over the joint and the floor elements will snap together, when installing floors according to the present invention. It is hereby becomes possible to walk the floor elements into position once they are placed correctly.

It is also possible to lay the floor standing up by using very simple tools, for example a couple of rods with a suction cup at the lower ends. It would thereby be possible to install the floor without having to crawl on ones knees. Industrial injuries such as back and knee problems are very common by floor installers. It also becomes possible to remove a floor element even though it is completely surrounded by other floor elements, provided it isn't glued. This operation is suitably achieved by using a more powerful type of suction cup to lift the floor element, one edge at the time. It is also possible to drill a hole in the floor element to be replaced in order to get a place to clutch the element. Among reasons why a single floor element needs to be changed are when a heavy object, such as a flat iron, is dropped on the floor. It has until now been possible only for a professional floor installer to achieve a repair in these types of floors since great experience of profession and a multitude of tool are needed. Such a repair is naturally very costly. It has through the present invention been made possible for a layman to achieve such a repair without having to utilise special tools.

The invention is described further together with enclosed drawings showing different embodiments of a flooring material according to the invention whereby, FIGS. 1*a*, 1*b*, 2*a* and 2*b* show in exploded view and in cross-section a first embodiment of joining members 21 and 22 to flooring material according to the invention, before the assembly.

FIGS. 3*a* and 3*b* show, in cross-section, an embodiment of a joining profile 50 to a flooring material according to the invention.

FIGS. 4*a* and 4*b* show, in cross-section, a second embodiment of joining members 21 and 22 to a flooring material according to the invention. The joint is shown before and after the final step of the assembly.

FIG. 5 shows, in cross-section, the embodiment of a joining profile 50 from FIGS. 3*a* and 3*b* just before the final step of the assembly.

FIG. 6 shows, in cross-section, an alternative embodiment of a joining profile 50 just before the final step of the assembly.

FIGS. 7*a*–7*c* show an embodiment of a flooring material comprising triangular floor elements 1.

FIGS. 8*a*–8*c* show an alternative embodiment of a flooring material comprising triangular floor elements 1.

FIGS. 9*a*–9*c* show an embodiment of a flooring material comprising square floor elements 1.

FIGS. 10*a*–10*c* show an alternative embodiment of a flooring material comprising square floor elements 1.

Figure 11A:
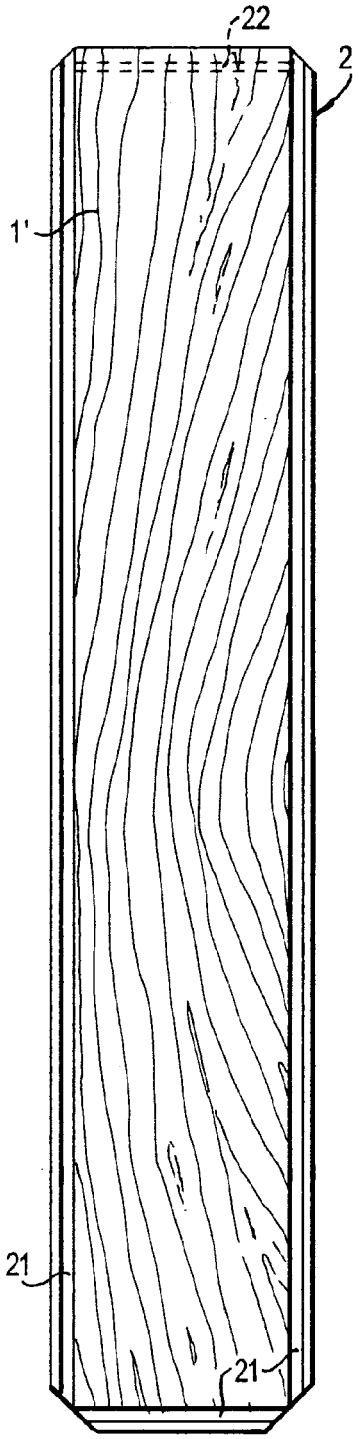
Figure 11B:
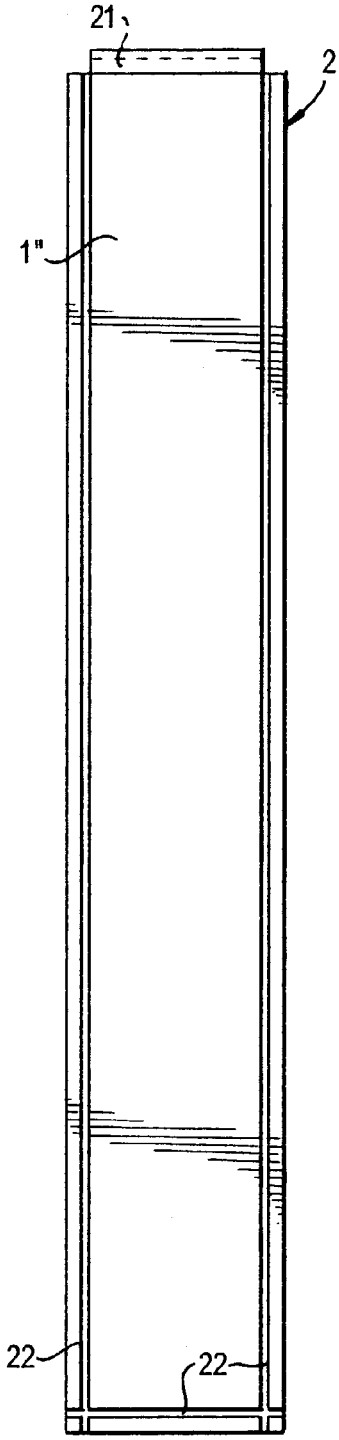
Figure 11C:
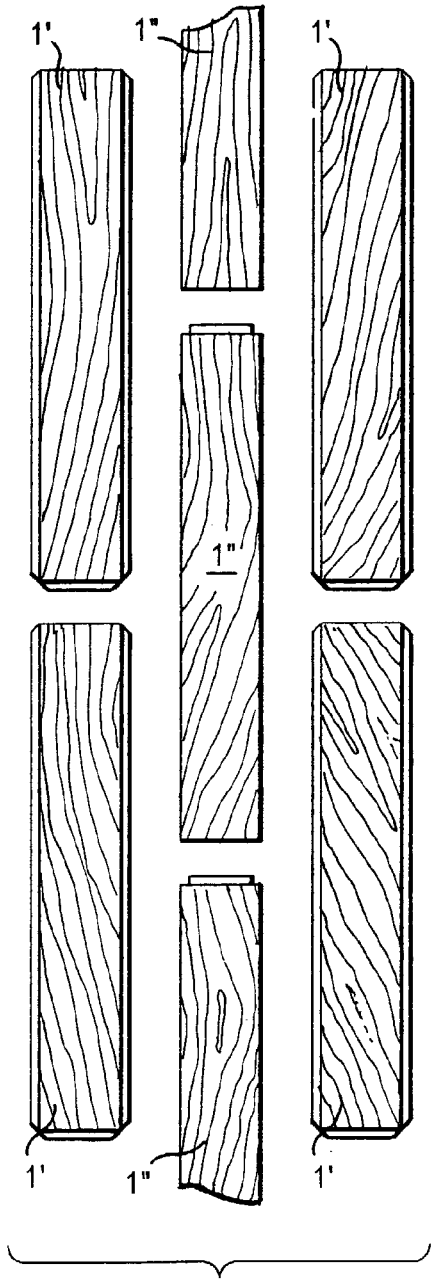

FIGS. 11*a*–11*c* show an embodiment of a flooring material comprising rectangular floor elements 1.

Figure 12A:
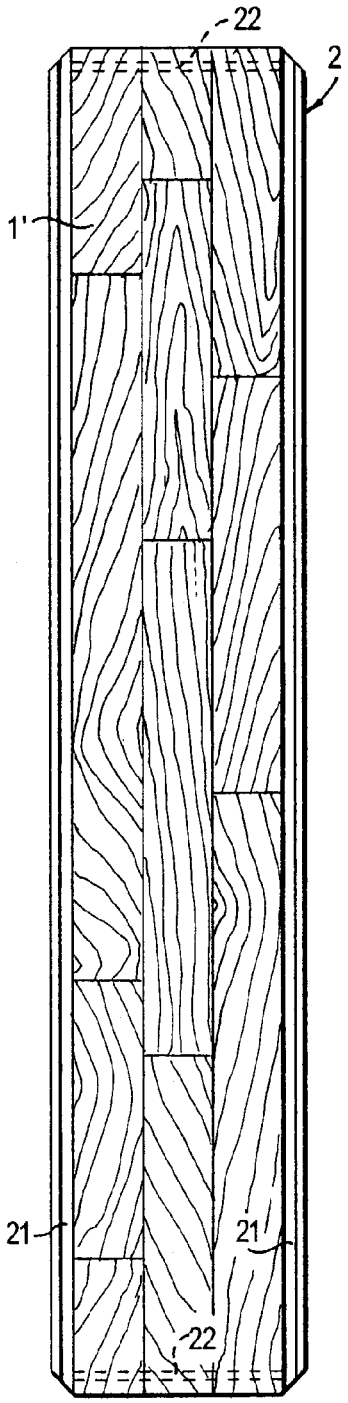
Figure 12B:
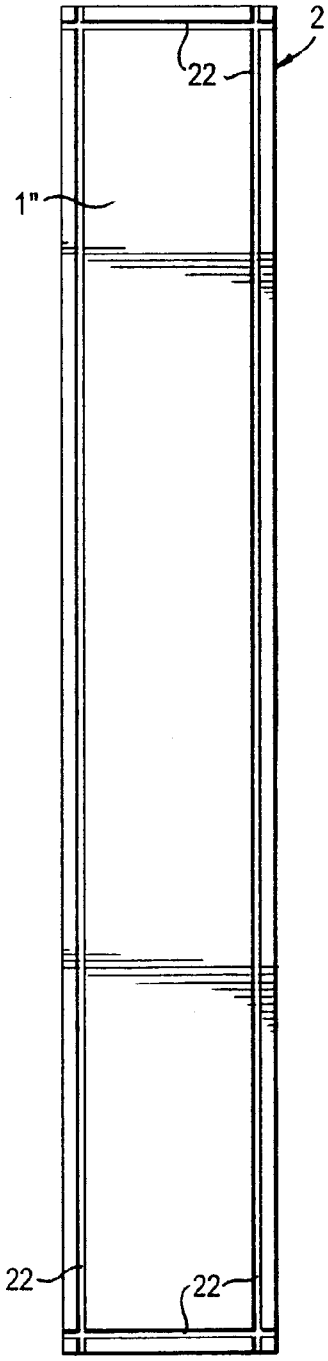
Figure 12C:
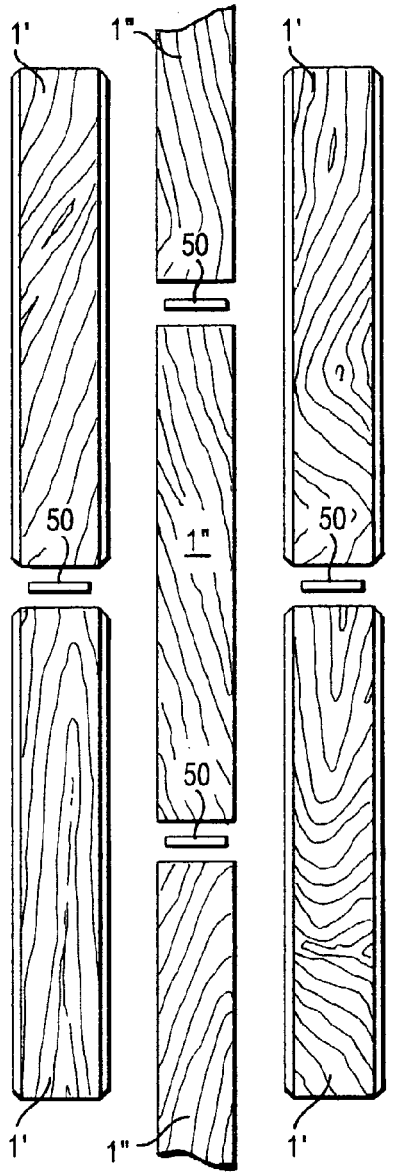

FIGS. 12*a*–12*c* show an alternative embodiment of a flooring material comprising rectangular floor elements 1 and joining profiles 50.

Figure 13A:
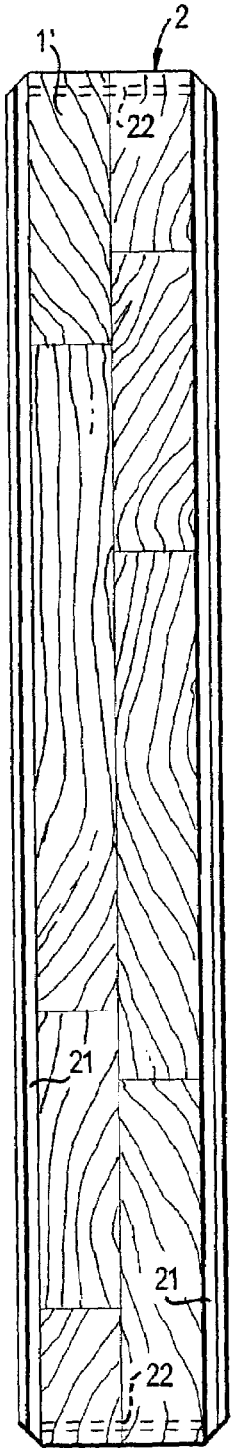
Figure 13B:
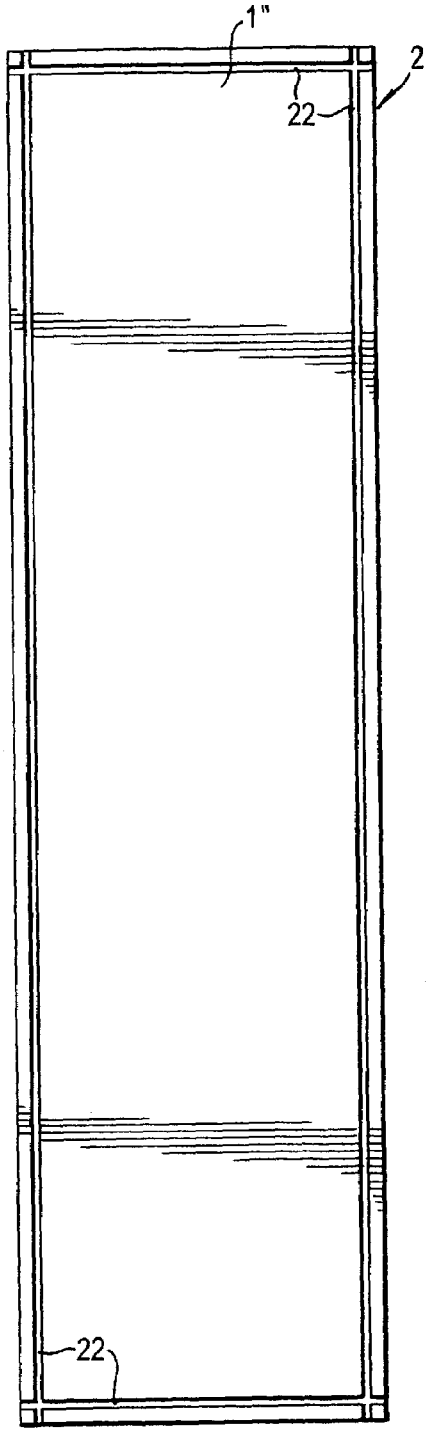
Figure 13C:
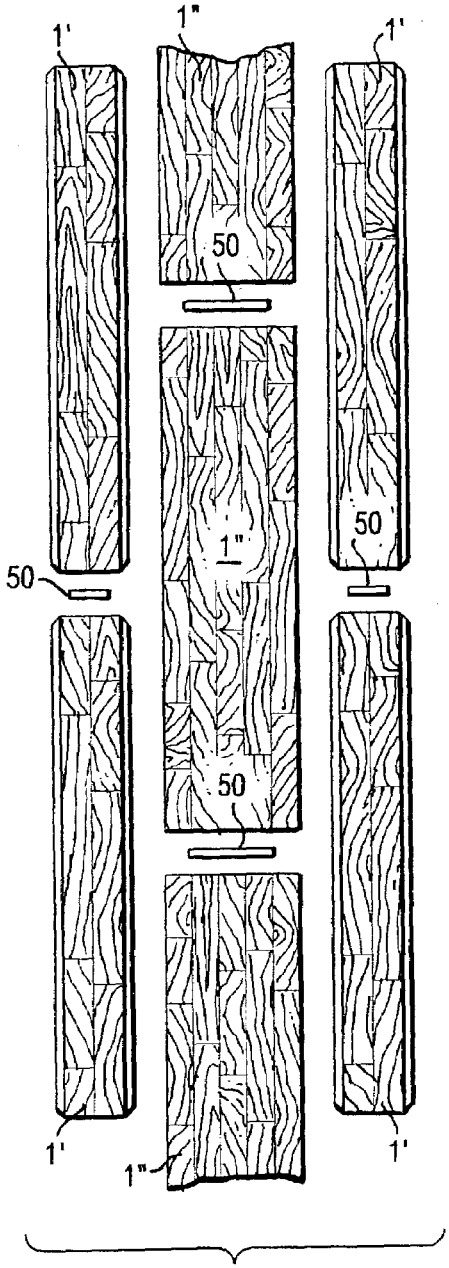

FIGS. 13*a*–13*c* show another alternative embodiment of a flooring material comprising rectangular floor elements 1 and joining profiles 50.

FIGS. 14*a*–14*c* show an embodiment of a flooring material comprising hexagonal floor elements 1.

FIGS. 15*a*–15*e* show an embodiment of a flooring material comprising extended hexagonal and square floor elements 1.

FIGS. 16*a*–16*e* show an embodiment of a flooring material comprising octagonal and square floor elements 1.

FIGS. 17*a*–17*d* show an alternative embodiment of a flooring material comprising extended hexagonal and square floor elements 1 shown in the FIGS. 15*a*–15*e*.

FIG. 18 show an embodiment of a male and female horizontal joining members 22' and 21' respectively.

FIGS. 19*a*–19*d* show an alternative embodiment of a flooring material comprising extended octagonal and square floor elements 1 shown in the FIGS. 16*a*–16*e*.

Figure 20A:
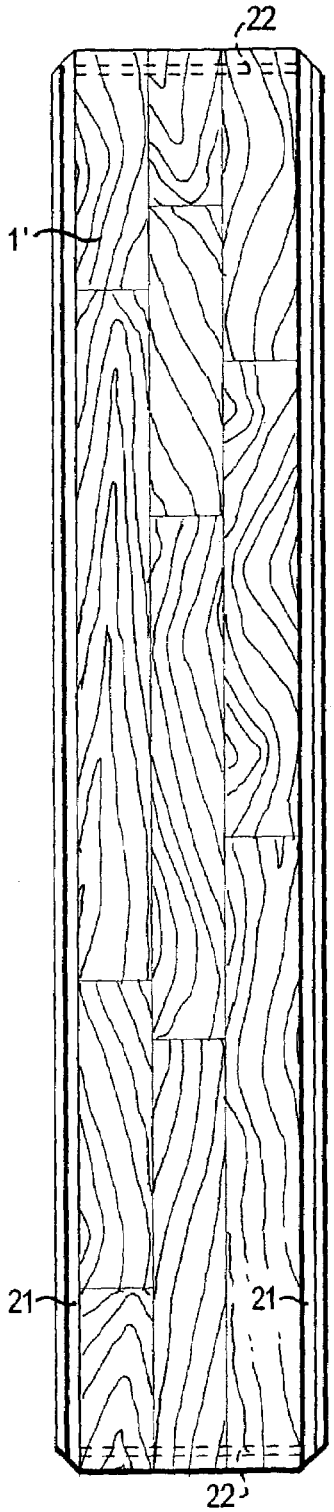
Figure 20B:
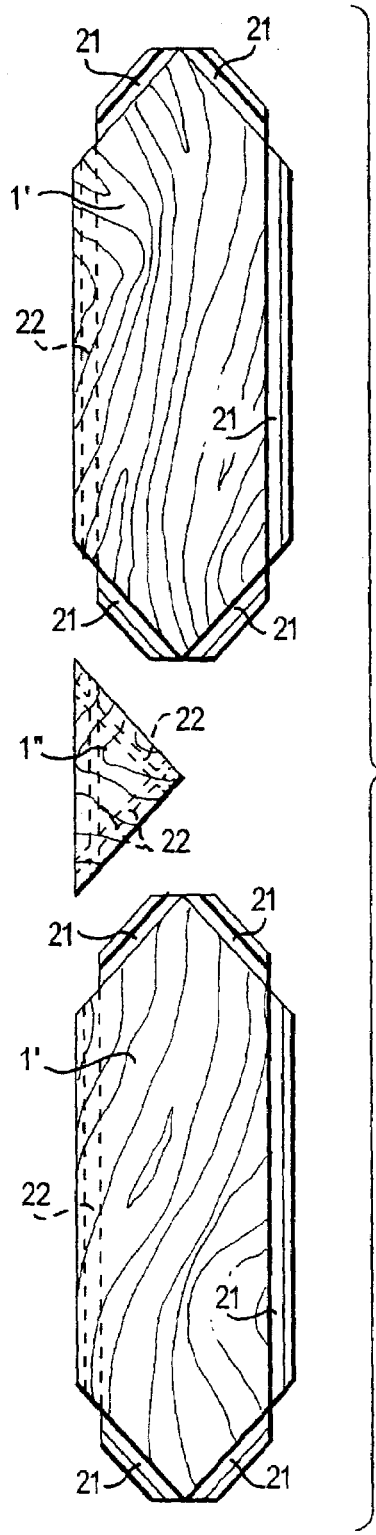

FIGS. 20*a*–20*b* shows an embodiment where a triangular male floor element 1" is used when joining rectangular floor elements 1 with hexagonal floor elements 1.

Accordingly, FIGS. 1*a*, 1*b*, 2*a* and 2*b* show in exploded view and in cross-section a first embodiment of joining members 21 and 22 to flooring material according to the invention, before the assembly. The flooring material, which is assembled vertically, comprises floor elements 1 with a mainly triangular, square, rectangular, rhomboidal or polygonal shape, as seen from above (see FIGS. 7–16). The floor elements 1 are provided with edges 2 which are provided with joining members 20. The floor elements 1 are further provided with a lower side 5 and a decorative top surface 3. The flooring material comprises a combination of at least two types of floor elements 1, which types comprises female floor elements 1' and male floor elements 1".

The female floor element 1' is provided with a female joining member 21 on at least half of the number of its edges 2 and a male joining member 22 on less than half of the number of its edges 2. The female joining member 21 comprises an upwards protruding lip 211, being parallel to the edge 2. The upwards protruding lip 211 is provided with a with a guiding surface 212, the guiding surface 212 facing the edge 2, and a locking groove 213, being parallel to the edge 2. The locking groove 213 has a locking surface 214 facing downwards, which locking surface 214 terminates in a locking edge 215. An angle αI between the guiding surface 212 and a vertical plane is 10°, while the angle αII between the locking surface 214 and a horizontal plane is 15° as seen in a perpendicular cross-section.

The male floor element 1" is provided with a male joining member 22 on at least two thirds of the number of its edges 2 and a female joining member 21 on less than one third of the number of its edges 2.

The male joining member 22 comprises a groove 221, with a guiding face 222, being parallel to the edge 2, on the lower side 5. The guiding face 222 is facing away from the edge 2. The male joining member 22 is also provided with a locking heel 223, being parallel to the edge 2. The locking heel has a locking face 224 facing upwards. An angle βI between the guiding face 222 and vertical plane is 10°, while an angle βII between the locking face 224 and a horizontal plane is 15° as seen in a perpendicular cross-section.

Accordingly, the angles αI and βI are the same and the angles αII and βII are also the same.

An optional joining profile 50 (see FIGS. 3*a* and 3*b*) may possibly constitute a junction between two adjacent male joining members 22 of two adjacent floor elements 1.

The section placed between the edges 2 and the grooves 221 has a thickness which is less than the maximum floor element thickness by a recess 6 on the lower side 5 of the floor element 1. The thickness of the floor element 1 is normally between 5 and 15 mm whereby a suitable depth of the recess 6 is 1–5 mm.

The width of the locking face 224 is depending on aspects like the thickness of the floor element 1, the material used in the core, the dimensions of the part between the locking groove 213 and the lower side 5 and the angles αI and βI chosen. The width of the locking face 224 is typically less than 30% of the thickness of the floor element which normally is between 5 and 15 mm whereby the width is less than 4.5 mm for floors with 15 mm thickness and 2.1 mm for a common floor element with a thickness of 7 mm. It has, however shown to be fully sufficient with a width between 0.2 mm and 1 mm.

Figure 1A:
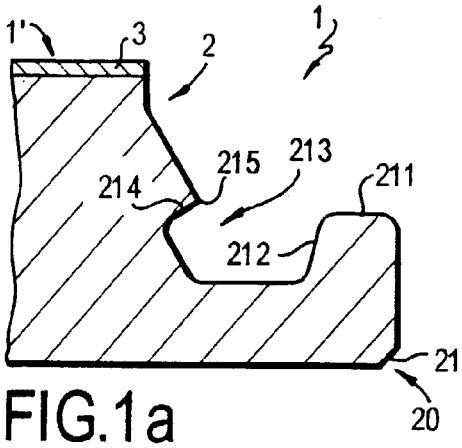
Figure 2A:
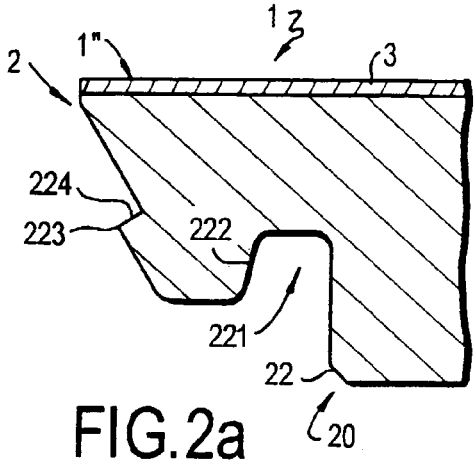
Figure 1B:
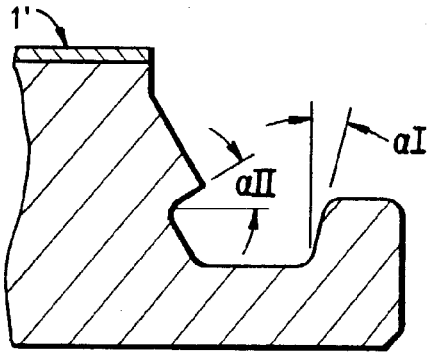
Figure 2B:
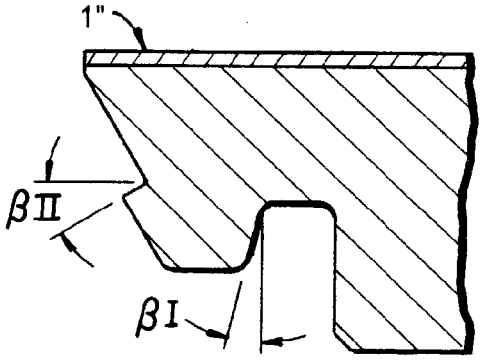
Figure 3B:
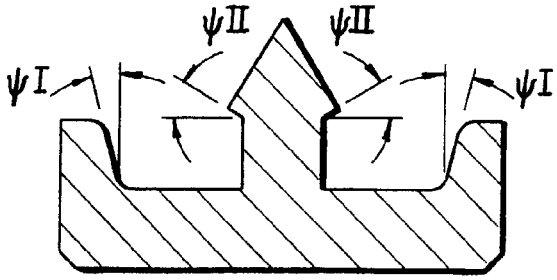
Figure 3A:
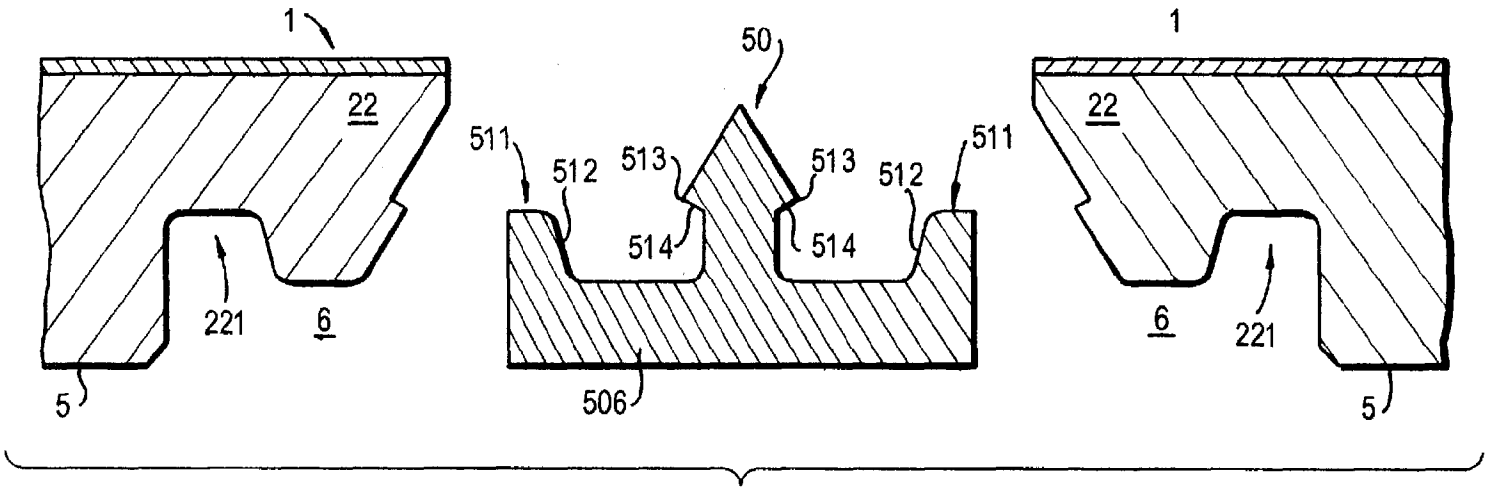

FIGS. 3*a* and 3*b* show, in cross-section, an embodiment of a joining profile 50 to a flooring material according to the invention. The joining profile is intended to be used as a junction between two male joining members 22. The joining profile 50 comprises two upwards protruding rims 511, being parallel to each other and distanced from each other by a centre section 506. The two upwards protruding rims 511 are provided with guiding areas 512. The guiding areas 512 are facing inwards. The joining profile is furthermore provided with two locking cheeks 513 placed on an extension 507. The locking cheeks 513 has locking areas 514 facing downwards, which locking areas 514 terminates in a locking edge 515. An angle ψI between the guiding area 512 and the vertical plane is 10° and the angle ψII between the locking area 514 and a horizontal plane is 15° as seen in a perpendicular cross-section.

Accordingly, the angles αI, βI (FIGS. 1 and 2) ψI and are the same and the angles αII, βII (FIGS. 1 and 2) ψII are also the same.

Figure 4B:
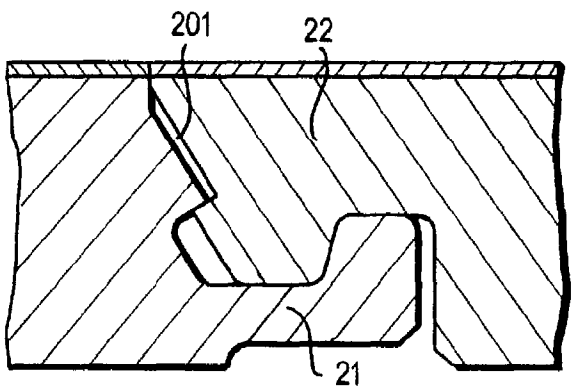
Figure 4A:
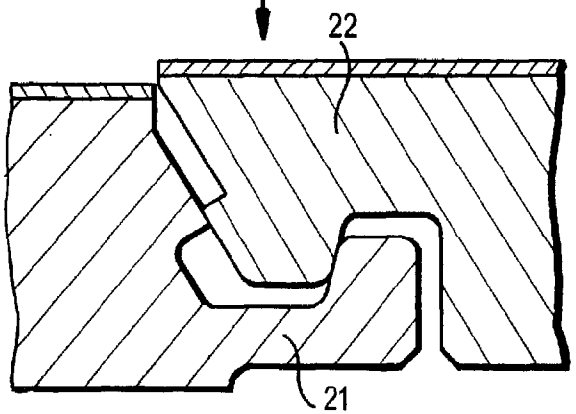

FIGS. 4*a* and 4*b* show, in cross-section, a second embodiment of joining members 21 and 22 to a flooring material according to the invention. The joint is shown before (FIG. 4*a*) and after (FIG. 4*b*) the final step of the assembly. The joining members corresponds mainly with the embodiment shown in FIGS. 1*a*, 1*b*, 2*a* and 2*b*. The joint is however provided with an upper cavity 201 which is supposed to collect and level residual glue when used. It will leave room for smaller particles that inevitably will be collected in the joint during the assembly of a floor. Such particles may otherwise obstruct the assembly and may cause unwanted gaps in the joint.

FIG. 5 shows, in cross-section, the embodiment of a joining profile 50 from FIGS. 3*a* and 3*b* just before the final step of the assembly. The joint is shown just before the final step of the assembly. The joining members corresponds with the embodiment shown in FIGS. 2*a*, 2*b*.

FIG. 6 shows, in cross-section, an alternative embodiment of a joining profile 50 just before the final step of the assembly. The male joining members 22 corresponds with the one shown in FIGS. 2*a* and 2*b*. The joining profile 50 corresponds in the main with the one shown in FIGS. 3*a* and 3*b*. The joining profile 50 is however provided with an inner cavity 51 extending parallel to the joining profile 50. The inner cavity 51 will allow some resilient action in the uppermost part of the joining profile 50, which facilitates the assembly.

The floor elements 1 most often includes a core which is covered with an upper decorative surface layer 3. The core is most often constituted of saw dust, fibre or particles of wood which are bonded together with glue or resin. Since the cellulose based material in the core is sensitive to moisture, it is advantageous to coat the surface closest to the joint if the floor will be exposed to moisture. This surface treatment may include wax, resin or some kind of lacquer. It is not necessary to coat the joint when the floor elements are to be glued together since the glue itself will protect from penetration of moisture.

The core may alternatively be constituted by saw dust, fibre or particles of wood bonded together with a thermoplastic material. Such a thermoplastic bonded cellulose based core will not be as sensitive to moisture as resin bonded, traditional counterpart. It is in most cases not necessary to coat the surfaces closest to the edge when utilising such a core.

Such a core may be constituted by a mixture of 4–6 parts by weight of particles such as wood fibre, with an average particle size in the range 50 $\mu$m–3000 $\mu$m which is agglomerated with 4–6 parts by weight of a thermoplastic polymer. The particles may partly or completely be constituted by another organic material such as bark, flax, straw, corn starch, fruit stones or the like. It is also possible to partly or completely replace the organic particles with inorganic ones such as stone dust, sand, lime, mica or the like.

The thermoplastic material is suitably constituted by a polyolefin such as polyethylene, polypropylene, or polybutene but can also be constituted by others such as polystyrene, acrylnitril-butadiene-styrene copolymer, poly amid, polyvinyl chloride or poly carbonate.

Additives might be added to the material in order to adapt the elastic and acoustic properties of the core to the desired one. Among such additives can mentioned ethyl-vinyl-acetate, di-ethyl-phthalate, di-isobutyl-phthalate or epoxidated organic oils.

It is also possible to use a core made of polyurethane, which is very impassive to moisture.

The upper decorative surface 3 may for example be constituted by a decorative paper impregnated with melamine-formaldehyde resin. One or more layers of so-called overlay paper made of $\alpha$-cellulose which are impregnated with melamine-formaldehyde resin are advantageously placed on top of the decorative paper. One or more of the layers may be sprinkled with hard particles, of for example, $\alpha$-aluminium oxide, silicon oxide or silicon carbide in connection to the impregnation in order to improve the abrasion resistance. The lower side 5 may be surface treated with lacquer or a surface layer of paper and resin.

The upper decorative surface may also be constituted by an acrylic foil, an acrylic lacquer and combinations thereof. It might also be constituted by a foil or a lacquer of polyolefins or polyolefin derivatives.

An adhesion problem between the different materials included in the floor element might occur in certain combinations. It is possible to overcome these problems which normally present themselves as de-lamination problems, low impact strength or blistering, by adding 0.01–1 part of dendritic macromolecules with a combination of chain terminators adapted to the characteristic materials of the floor element in order to increase the chemical bond between the different materials. It is also possible to coat a decorative surface with an acrylic lacquer containing, or being sprinkled with, hard particles of $\alpha$-aluminium oxide, silicon carbide or silicon oxide. The coating is most often achieved through use of a roller or through curtain coating. Among suitable acrylic lacquers can be mentioned radiation curing ones which are cured with electron beam or ultraviolet light forming free radicals in the uncured lacquer.

FIGS. 7*a*–7*c* show an embodiment of a flooring material comprising triangular floor elements 1. FIG. 7*a* shows the female floor element 1' from above while FIG. 7*b* shows the male floor element 1" from below. FIG. 7*c* shows schematically how the floor elements 1 are positioned for assembly. The female floor element 1' is mainly triangular, as seen from above, and is provided with female joining members 21, (see FIGS. 2*a* and 2*b*), on all three edges 2. The male floor element 1" is mainly triangular, as seen from above, and is provided with male joining members 22, (see FIGS. 2*a* and 2*b*), on all three edges 2.

FIGS. 8*a*–8*c* show an alternative embodiment of a flooring material comprising triangular floor elements 1. FIG. 8*a* shows the female floor element 1' from above while FIG. 8*b* shows the male floor element 1" from below. FIG. 8*c* shows schematically how the floor elements 1 are positioned for assembly. The female floor element 1' is mainly triangular, as seen from above, and is provided with female joining members 21 (see FIGS. 1*a* and 1*b*) on two edges 2 and a male joining member 22, (see FIGS. 2*a* and 2*b*), on the remaining edge 2. The male floor element 1" is mainly triangular, as seen from above, and is provided with male joining members 22, (see FIGS. 2*a* and 2*b*), on two edges 2 and a female joining member 21 (see FIGS. 1*a* and 1*b*) on the remaining edge 2.

FIGS. 9*a*–9*c* show an embodiment of a flooring material comprising square floor elements 1. FIG. 9*a* shows the female floor element 1' from above while FIG. 9*b* shows the male floor element 1" from below. FIG. 9*c* shows schematically how the floor elements 1 are positioned for assembly. The female floor element 1' is mainly square, as seen from above, and is provided with female joining members 21 (see FIGS. 1*a* and 1*b*) on all four edges 2. The male floor element 1" is mainly square, as seen from above, and is provided with male joining members 22, (see FIGS. 2*a* and 2*b*), on all four edges 2.

FIGS. 10*a*–10*c* show an alternative embodiment of a flooring material comprising square floor elements 1. FIG. 10*a* shows the female floor element 1' from above while FIG. 10*b* shows the male floor element 1" from below. FIG. 10*c* shows schematically how the floor elements 1 are positioned for assembly. The female floor element 1' is mainly square, as seen from above, and is provided with female joining members 21 (see FIGS. 1*a* and 1*b*) on three edges 2 and a male joining member 22, (see FIGS. 2*a* and 2*b*), on the remaining edge 2, while the male floor element 1" is mainly square, as seen from above, and is provided with male joining members 22 (see FIGS. 2*a* and 2*b*) on three edges 2 and a female joining member 21 (see FIGS. 1*a* and 1*b*) on the remaining edge 2.

FIGS. 11*a*–11*c* show an embodiment of a flooring material comprising rectangular floor elements 1. FIG. 11*a* shows the female floor element 1' from above while FIG. 11*b* shows the male floor element 1" from below. FIG. 11*c* shows schematically how the floor elements 1 are positioned for assembly. The female floor element 1' is mainly rectangular, as seen from above, and is provided with female joining members 21, (see FIGS. 1*a* and 1*b*) on two long side edges 2 and one short side edge 2 and a male joining member 22 (see FIGS. 2*a* and 2*b*) on the remaining short side edge 2.

The male floor element 1" is mainly rectangular, as seen from above, and is provided with male joining members 22 (see FIGS. 2*a* and 2*b*) on two long side edges 2 and one short side edge 2 and a female joining member 21 on the remaining short side edge 2.

FIGS. 12*a*–12*c* show an alternative embodiment of a flooring material comprising rectangular floor elements 1 and joining profiles 50. FIG. 12*a* shows the female floor element 1' from above while FIG. 12*b* shows the male floor element 1" from below. FIG. 12*c* shows schematically how the floor elements 1 and joining profiles 50 are positioned for assembly. The female floor element 1' is mainly rectangular, as seen from above, and is provided with female joining members 21 (see FIGS. 1*a* and 1*b*) on two long side edges 2 and male joining members 22 (see FIGS. 2*a* and 2*b*) on the short side edges 2. The male floor element 1" is mainly rectangular, as seen from above, and is provided with male joining members 22 (see FIGS. 2*a* and 2*b*) on all four edges 2. The adjacent short side edges 2 are joined by means of a joining profile 50 (see FIGS. 3*a* and 3*b*.

FIGS. 13*a*–13*c* show another alternative embodiment of a flooring material comprising rectangular floor elements 1 and joining profiles 50. FIG. 13*a* shows the female floor element 1' from above while FIG. 13*b* shows the male floor element 1" from below. FIG. 13*c* shows schematically how the floor elements 1 and joining profiles 50 are positioned for assembly. The embodiment shown in FIGS. 13*a*–13*c* corresponds mainly with the one shown in FIGS. 12*a*–12*c*. The width to length ratio between the female floor element 1' and the male floor element 1" does, however, differ.

FIGS. 14*a*–14*c* show an embodiment of a flooring material comprising hexagonal floor elements 1. FIG. 14*a* shows the female floor element 1' from above while FIG. 14*b* shows the male floor element 1" from below. FIG. 14*c* shows schematically how the floor elements 1 are positioned for assembly. The female floor element 1' is mainly hexagonal, as seen from above, and is provided with female joining members 21 (see FIGS. 1*a* and 1*b*) on five edges 2 and a male joining member 22 (see FIGS. 2*a* and 2*b*) on the remaining edge 2. The male floor element 1" is mainly hexagonal, as seen from above, and is provided with male joining members 22 (see FIGS. 2*a* and 2*b*) on five edges 2 and a female joining member 21 (see FIGS. 1*a* and 1*b*) on the remaining edge 2.

FIGS. 15*a*–15*e* show an embodiment of a flooring material comprising extended hexagonal and square floor elements 1. FIG. 15*a* shows the female floor element 1' from above while FIG. 15*b* shows the same female floor element 1' from below. FIG. 15*c* shows the male floor element 1" from above while FIG. 15*d* shows the same male floor element 1" from below. FIG. 15*e* shows schematically how the floor elements 1 are positioned for assembly. The female floor element 1' is mainly hexagonal with two of the parallel edges 2 extended, as seen from above, and is provided with female joining members 21 (see FIGS. 1*a* and 1*b*) on five edges 2 and a male joining member 22 (see FIGS. 2*a* and 2*b*) on one of the extended edges 2. The male floor element 1" is mainly square with male joining members 22 (see FIGS. 2*a* and 2*b*) on all four edges 2.

FIGS. 16*a*–16*e* show an embodiment of a flooring material comprising octagonal and square floor elements 1. FIG. 16*a* shows the female floor element 1' from above while FIG. 16*b* shows the same female floor element 1' from below. FIG. 16*c* shows the male floor element 1" from above while FIG. 16*d* shows the same male floor element 1" from below. FIG. 16*e* shows schematically how the floor elements 1 are positioned for assembly. The female floor element 1' is mainly octagonal, as seen from above, and is provided with female joining members 21 (see FIGS. 1*a* and 1*b*) on six edges 2 and male joining members 22 (see FIGS. 2*a* and 2*b*) on the two remaining edges 2. The male floor element 1" is mainly square with male joining members 22 (see FIGS. 2*a* and 2*b*) on all four edges 2.

Figure 17A:
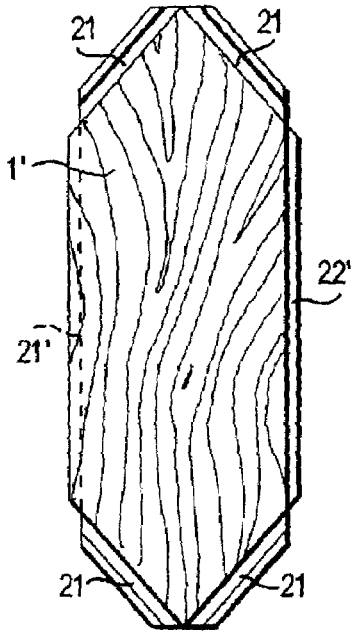
Figure 17B:
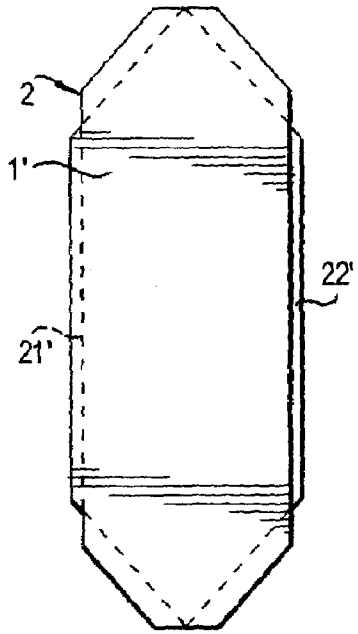
Figure 17C:
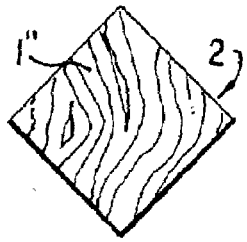
Figure 17D:
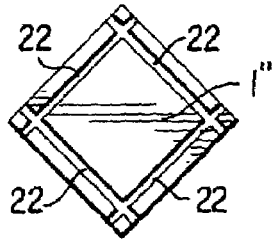

FIGS. 17*a*–17*d* show an alternative embodiment of a flooring material comprising extended hexagonal and square floor elements 1 shown in the FIGS. 15*a*–15*e*. FIG. 17*a* shows the female floor element 1' from above while FIG. 17*b* shows the same female floor element 1' from below. FIG. 17*c* shows the male floor element 1" from above while FIG. 17*d* shows the same male floor element 1" from below. The embodiment shown in FIGS. 17*a*–17*d* corresponds in the main with the embodiment shown in FIGS. 15*a*–15*e*, the female floor element 1' is, however, provided with a female horizontal joining member 21' (see FIG. 18) on one extended edge 2 and a male horizontal joining member 22' (see FIG. 18) on the opposite edge 2. The hexagonal female floor elements 1' will hereby be assembled by being pushed together horizontally and will be locked together by male floor elements 1" pressed down in the space formed between the female floor elements 1'. Accordingly the female floor element 1' is mainly hexagonal with two of the parallel edges 2 extended, as seen from above, and is provided with female joining members 21 (see FIGS. 1*a* and 1*b*) on the four shorter edges 2, a female horizontal joining member 22' on one of the extended edges 2 and, a male horizontal joining member 21' on the remaining extended edge 2. The male floor element 1" is mainly square with male joining members 22 on all four edges 2.

FIG. 18 shows, in cross-section, an embodiment of a male and female horizontal joining members 22' and 21' respectively. The horizontal joining members 21' and 22' respectively are of the traditional tongue and groove type.

Figure 19A:
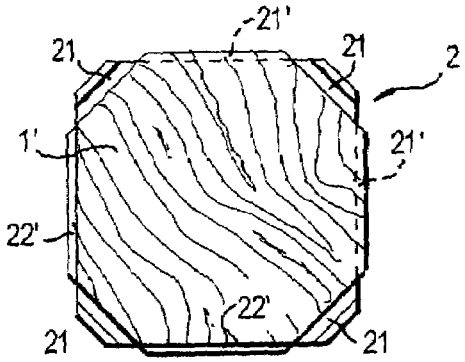
Figure 19B:
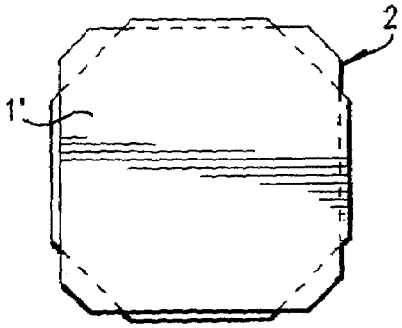
Figure 19C:
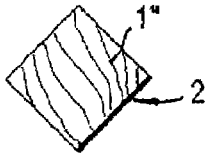
Figure 19D:
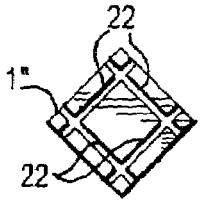

FIGS. 19*a*–19*d* show an alternative embodiment of a flooring material comprising extended octagonal and square floor elements 1 shown in the FIGS. 16*a*–16*e*. FIG. 19*a* shows the female floor element 1' from above while FIG. 19*b* shows the same female floor element 1' from below. FIG. 19*c* shows the male floor element 1" from above while FIG. 19*d* shows the same male floor element 1" from below. The embodiment shown in FIGS. 19*a*–19*d* corresponds in the main with the embodiment shown in FIGS. 16*a*–16*d*, the female floor element 1' is, however, provided with a female horizontal joining member 21' (see FIG. 18) on two perpendicularly arranged edges 2 and a male horizontal joining member 22' (see FIG. 18) on two opposite edges 2. The octagonal female floor elements 1' will hereby be assembled by being pushed together horizontally and will be locked together by male floor elements 1" pressed down in the space formed between the female floor elements 1'. Accordingly the female floor element 1' is mainly octagonal, as seen from above, and is provided with female joining members 21 (see FIGS. 1*a* and 1*b*) on four perpendicularly arranged edges 2, female horizontal joining members 21' on two edges 2, and male horizontal joining members 22' on the two remaining edges 2. The male floor element 1" is mainly square with male joining members 22 (see FIGS. 2*a* and 2*b*) on all four edges 2.

FIG. 20 shows an embodiment where a triangular male floor element 1" similar to the one shown in FIG. 7*b* is used when joining rectangular floor elements 1 similar to the one shown in FIG. 15*a*–*b* with hexagonal floor elements 1 similar to the one shown in FIG. 12*a*.

The flooring material comprising the embodiments described above is very suited when installing floors where no glue is to be used. It is, of course, possible to utilise glue or adhesive tape to make the installation irreversibly permanent. The glue or tape is then suitably applied in, or in connection to, possible cavities before joining the floor elements 1.

The invention is not limited by the embodiments shown since it can be altered in several ways within the scope of the invention.

What is claimed is:

1. A vertically joined flooring material comprising vertically joinable floor elements with a polygonal shape, the floor elements being provided with edges which are provided with joining members, a lower side and a decorative top surface, wherein the flooring material comprises a combination of female floor elements and male floor elements, wherein a plurality of said female floor elements are adjacent to at least one of said male floor elements, wherein, a) the female floor element is provided with a female joining member on at least half of the number of its edges, the female joining member comprising a locking groove extending outwards and upwards from the edge, a locking surface projecting outwards and facing downwards from the locking groove and terminated by an inclined locking edge, the female floor element further comprising a female horizontal joining member on at least one edge and at least one male horizontal joining member on an opposite edge and that, b) the male floor element is provided with a male joining member on all of its edges, the male joining member comprising a locking heel extending inwards and downwards from the edge, a locking face extending inwards and facing upwards from the locking heel and terminated by an inclined locking edge, so that the male floor element is used for locking a number of floor elements into a unity by engaging the female joining members of a plurality of female floor elements.

2. Flooring material according claim 1, wherein the female joining member, comprises an upwards protruding lip having a guiding surface, the guiding surface facing the edge, the female joining member further comprising the locking groove, having the locking surface facing downwards, which locking surface terminates in a locking edge, that an angle $\alpha I$ between the guiding surface and vertical plane is in the range 0–30° and that an angle $\alpha II$ between the locking surface and a horizontal plane is in the range 0–30° as seen in a perpendicular cross-section, and that, the male joining member comprises a lower side groove having a guiding face facing away from the edge and the locking heel, having the locking face facing upwards, that an angle $\beta I$ between the guiding face and vertical plane is in the range 0–30° and that an angle $\beta II$ between the locking face and a horizontal plane is in the range 0–30° as seen in a perpendicular cross-section whereby, the angles $\alpha I$ and $\beta I$ are mainly the same and that also the angles $\alpha II$ and $\beta II$ are mainly the same.

3. Flooring material according claim 1, wherein the part of the floor element located between each edge and its respective groove is thinner than the maximum thickness of the floor element by means of a recess located on the lower side.

4. Flooring material according to claim 1, wherein the edges of the floor elements are at least partially coated with glue or adhesive tape.

5. Flooring material according to claim 1, wherein the width to length ratio between the female floor element and the male floor element differs.

6. Flooring material according to claim 1, wherein the female floor element is hexagonal, having four shorter edges and two parallel edges extended, the female floor element comprising female joining members on the four shorter edges, a female horizontal joining member on one of the extended edges and a male horizontal joining member on the remaining extended edge, while the male floor element is mainly square with male joining members on all four edges.

7. Flooring material according to claim 1, wherein the female floor element is mainly octagonal, as seen from above, and is provided with female joining members on four perpendicularly arranged edges, female horizontal joining members on two edges and male horizontal joining members on the two remaining edges, while the male floor element is mainly square with male joining members on all four edges.

* * * * *